US006146222A

United States Patent [19]

Murata et al.

[11] Patent Number: 6,146,222

[45] Date of Patent: Nov. 14, 2000

[54] COOLING DEVICE IN OUTBOARD ENGINE SYSTEM

[75] Inventors: Hiroyuki Murata; Makoto Miyake; Hiroshi Mizuguchi, all of Wako, Japan

[73] Assignee: Honda Giken Kogyo Kabushiki Kaisha, Tokyo, Japan

[21] Appl. No.: 09/404,311

[22] Filed: Sep. 24, 1999

[30] Foreign Application Priority Data

Sep. 28, 1998 [JP] Japan ..... 10-273881

[51] Int. Cl.[7] ..... B63H 23/32

[52] U.S. Cl. ..... 440/83; 440/52; 440/76; 440/89

[58] Field of Search ..... 440/52, 83, 76, 440/88, 89

[56] References Cited

U.S. PATENT DOCUMENTS 2,676,559 4/1954 Davies ..... 440/89
3,968,767 7/1976 Blanchard ..... 440/75
6,033,274 7/1976 Mizuguchi et al. ..... 440/89

FOREIGN PATENT DOCUMENTS 62-22200 2/1987 Japan .

*Primary Examiner*—Sherman Basinger
*Attorney, Agent, or Firm*—Arent Fox Kintner Plotkin & Kahn, PLLC

[57] ABSTRACT

In an outboard engine, a support member for supporting a drive shaft and an exhaust pipe within an extension case can be cooled by outside water pumped by utilizing the exhaust pressure from the engine. The inside of the extension case is divided, by the support member for supporting the drive shaft and the exhaust pipe, into an upper chamber communicating with the open air, and a lower chamber into which outside water is introduced, so that the exhaust gas from the exhaust pipe is discharged into the lower chamber. Both the upper and lower chambers are in communication with each other through a communication pipe. Thus, during operation of the engine, the support member and the depending members are cooled by the outside water forced up from the lower chamber through the communication pipe into the upper chamber.

6 Claims, 9 Drawing Sheets

4
31
25
$36_1$
$4_1$
4
5
5
4a
W
20
35
41
7
7
47
20
4b
$4_2$
48
$36_2$
46
50
39
21
4c
8
8
38
21
6a
40
6
30
22
26
34
4

COOLING DEVICE IN OUTBOARD ENGINE SYSTEM

BACKGROUND OF THE INVENTION

1. Field of the Invention

The present invention relates to an outboard engine system including an extension case which interconnects an engine support portion for supporting the engine and a gear case which supports a propeller shaft and in which a gear device for driving the propeller shaft is accommodated. A support member is mounted in the extension case for suppressing the deflection of a depending member, such as a drive shaft and an exhaust pipe, which depends from the engine into the extension case. More particularly, the present invention is directed to a cooling device in an outboard engine system, which is designed to cool the depending member and the support member using outside water around the extension case.

2. Description of the Prior Art

An outboard engine system is known, as disclosed, for example, in Japanese Utility Model Application Laid-open No. 62-22200, which includes an extension case which interconnects an engine support portion for supporting an engine and a gear case which supports a propeller shaft and in which a gear device for driving the propeller shaft is accommodated. A support member is mounted in the extension case for suppressing the deflection of a depending member such as a drive shaft and an exhaust pipe depending from the engine into the extension case.

In order to cool the depending members and the support member in such outboard engine system, outside water pumped by a water pump is splashed onto the support member and the depending members. In such a system, an expensive water pump is indispensable and hence, an increase in cost is unavoidable.

SUMMARY OF THE INVENTION

The present invention has been accomplished with such circumstances in view, and it is an object of the present invention to provide a cooling device in an outboard engine system of the above-described type, wherein the outside water can be pumped by utilizing the exhaust pressure from the engine without the use of a special water pump, thereby cooling the support member and the depending member.

To achieve the above object, according to a first aspect and feature of the present invention, there is provided a cooling device in an outboard engine system comprising an extension case which interconnects an engine support portion for supporting an engine and a gear case which supports a propeller shaft and in which a gear device for driving the propeller shaft is accommodated, and a support member which is mounted in the extension case for suppressing the deflection of depending members depending from the engine into the extension case. The inside of the extension case is divided by the support member into an upper chamber communicating with the open air, and a lower chamber defined so that the outside water around the extension case, is introduced into the lower chamber. A communication pipe is mounted between the upper and lower chambers, and opens at its lower end into the lower chamber in the vicinity of or below the surface of the outside water introduced into the lower chamber, and at the other end into the upper chamber. An exhaust gas pressure introducing means is connected to the lower chamber for introducing exhaust gas pressure from the engine into the lower chamber, whereby the support member and the depending member are cooled by the outside water forced up from the lower chamber through the communication pipe into the upper chamber by the difference in pressure between the chambers during operation of the engine.

With the first feature, during operation of the engine, the deflection of the depending member depending from the engine can be inhibited by the support member supporting the depending members. Moreover, the exhaust pressure from the engine is introduced into the lower chamber in the extension case and hence, the water within the lower chamber or a mixture of the water and the exhaust gas is forced up through the communication pipe into the upper chamber, whereby the support member and the depending members can be cooled by the water. In this way, the exhaust pressure from the engine is utilized to force up the water from the lower chamber into the upper chamber and hence, a special water pump is not required.

According to a second aspect and feature of the present invention, the depending member is a drive shaft for transmitting the power of the engine to the gear device, and cooling grooves are defined in an inner peripheral surface of a bearing bush mounted to the support member to support an intermediate portion of the drive shaft for rotation, so that the upper and lower chambers are permitted to communicate with each other through the cooling grooves.

With the second feature, the water forced up from the lower chamber into the upper chamber passes through the cooling grooves in the inner peripheral surface of the bearing bush and drops into the lower chamber, whereby the bearing bush and the drive shaft supported by the bearing bush and rotated can be effectively cooled. At the same time, the increase in amount of water accumulated on the support member can be suitably suppressed.

According to a third aspect and feature of the present invention, the depending member is an exhaust pipe of the engine which opens at its outlet into the lower chamber.

With the third feature, it is possible to easily perform the introduction of the exhaust pressure into the lower chamber by the exhaust pipe passing through the support member, and to inhibit the deflection of the exhaust pipe and to cool the exhaust pipe.

According to a fourth aspect and feature of the present invention, the extension case is provided with an exhaust outlet which permits the lower chamber to open below the surface of the outside water around the extension case, and water intake bores for introducing the outside water into the lower chamber.

With the fourth feature, the surface of the water within the lower chamber can be stabilized to stabilize the forcing-up of the water through the communication pipe into the upper chamber, by balancing the discharge of the water from the lower chamber into the exhaust outlet using the exhaust pressure with the introduction of the outside water through the water intake bores into the lower chamber.

According to a fifth aspect and feature of the present invention, the water intake bores are formed in a lateral sidewall of the extension case, and guiding projection walls are formed in the sidewall of the extension case for guiding the dynamic pressure of outside water into the water intake bores during cruising of a boat.

With the fifth feature, it is possible to reliably perform the introduction of the outside water into the lower chamber by utilizing the outside water flow during cruising of the boat.

According to a sixth aspect and feature of the present invention, the extension case comprises an extension case body connected to the engine support portion, and an additional case detachably interposed between the extension case body and the gear case. The support member is mounted in a lower portion of the extension case body.

With the sixth feature, even when the additional case is removed and the gear case is coupled directly to the extension case body, the deflection of the depending members, i.e., the drive shaft and the exhaust pipe can be suppressed by the support member in the extension case.

BRIEF DESCRIPTION OF THE DRAWINGS

The mode for carrying out the present invention will now be described by way of an embodiment shown in the accompanying drawings.

DETAILED DESCRIPTION OF THE PREFERRED EMBODIMENT

Figure 1:
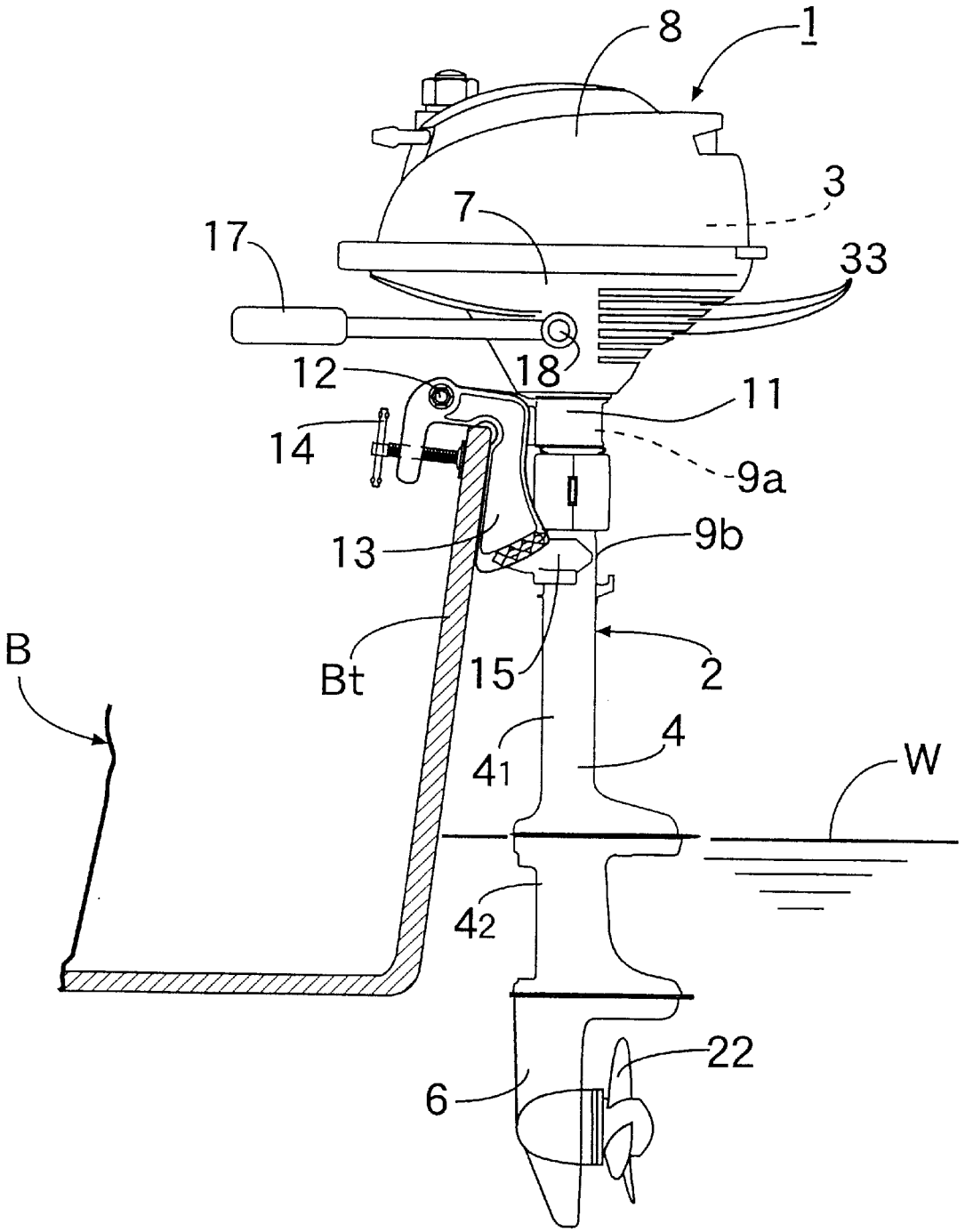
FIG. 1 is a side view of an outboard engine system including a cooling device according to the present invention and mounted to the transom of a boat, which is relatively high in height.
Figure 2:
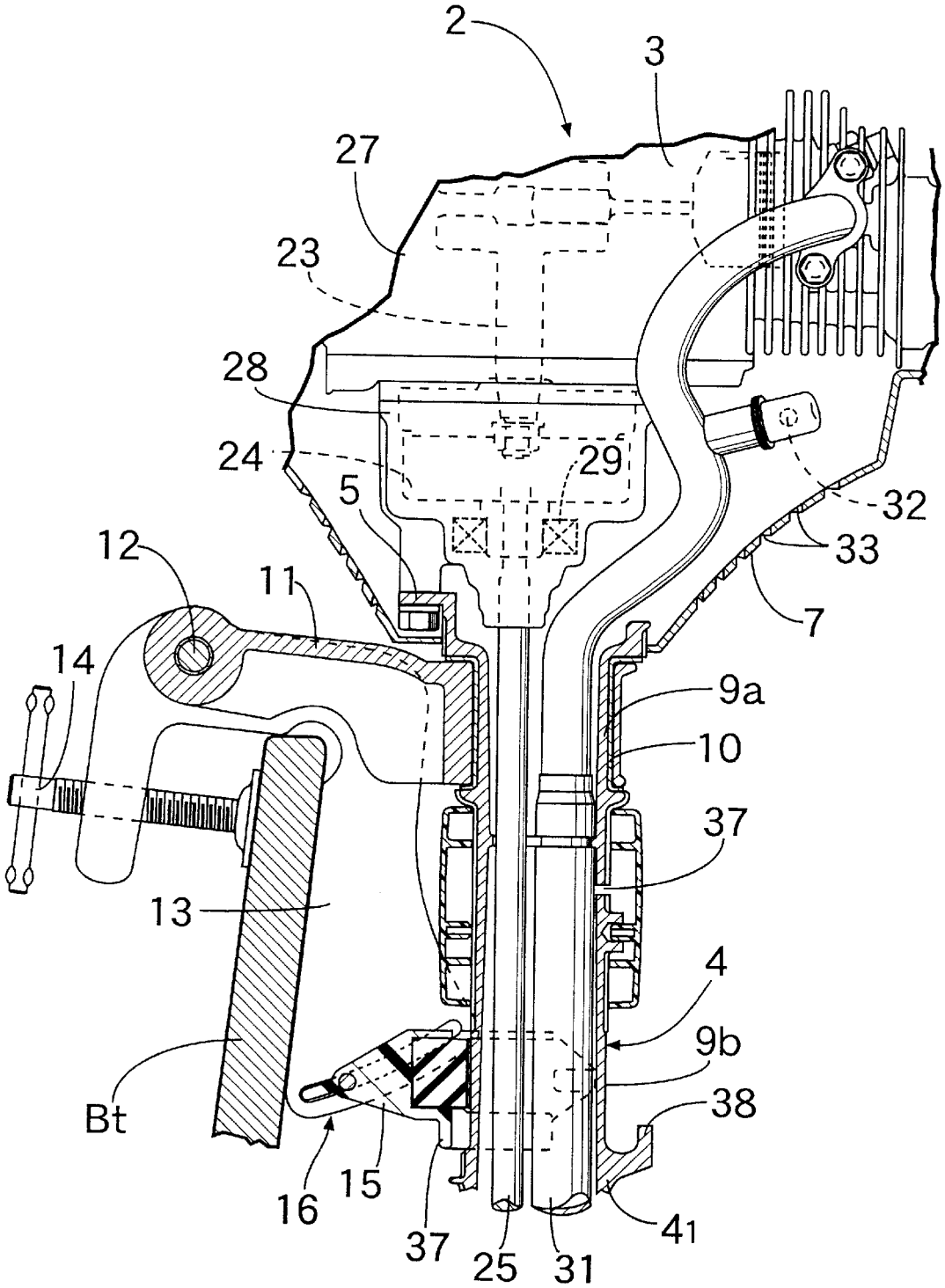
FIG. 2 is an enlarged vertical sectional view of upper half of the outboard engine system.
Figure 3:
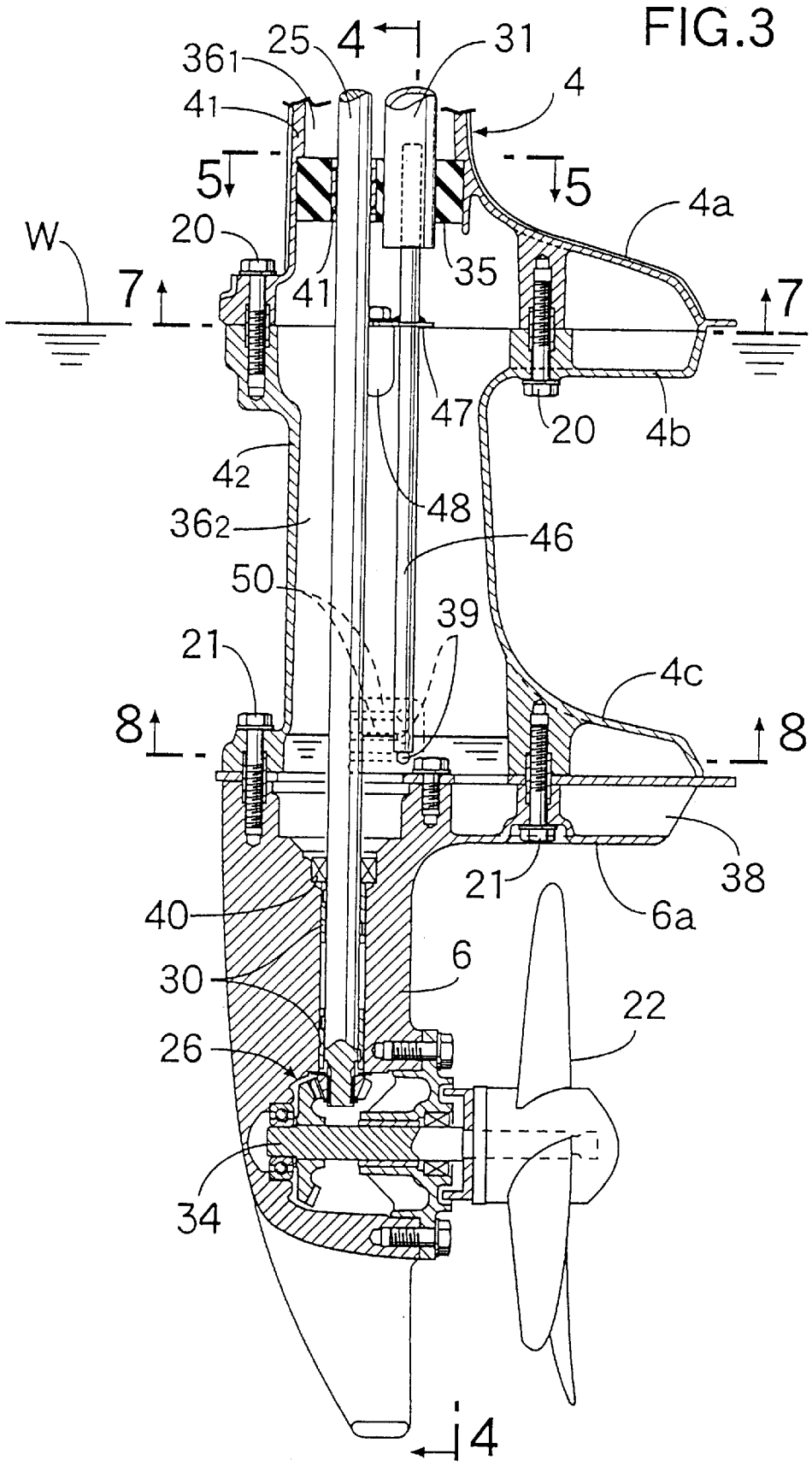
FIG. 3 is an enlarged vertical sectional view of lower half of the outboard engine system.
Figure 4:
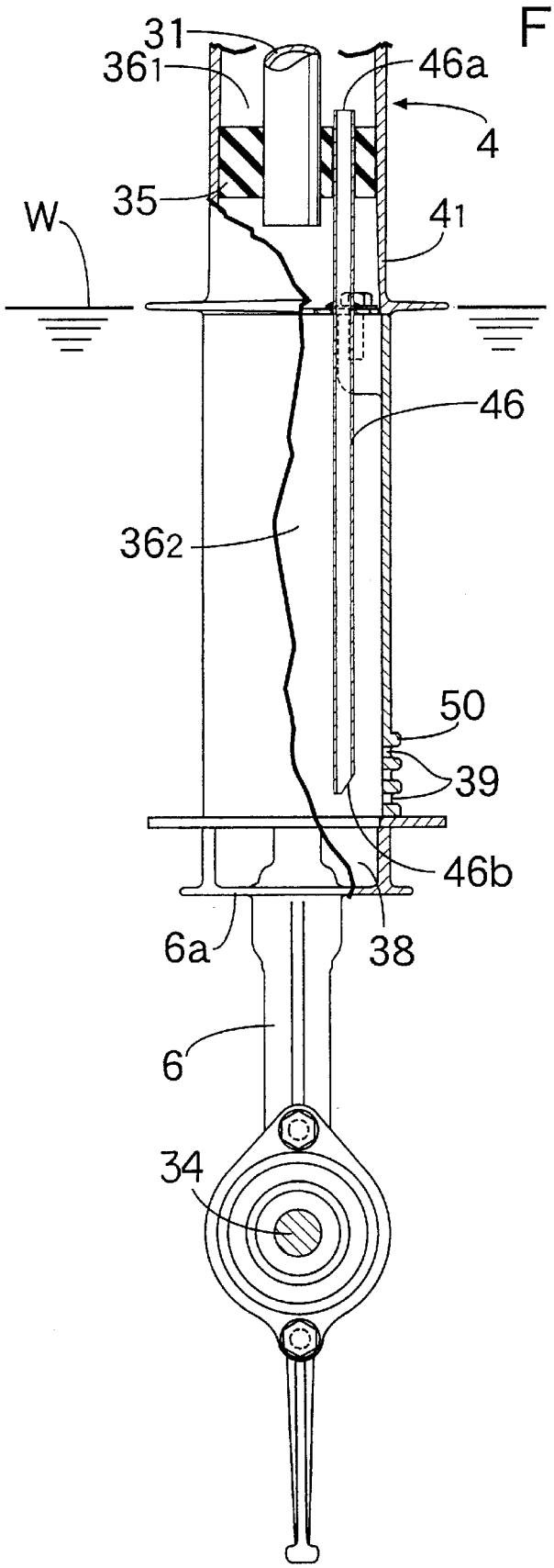
FIG. 4 is a sectional view taken along a line 4—4 in FIG. 3.
Figure 5:
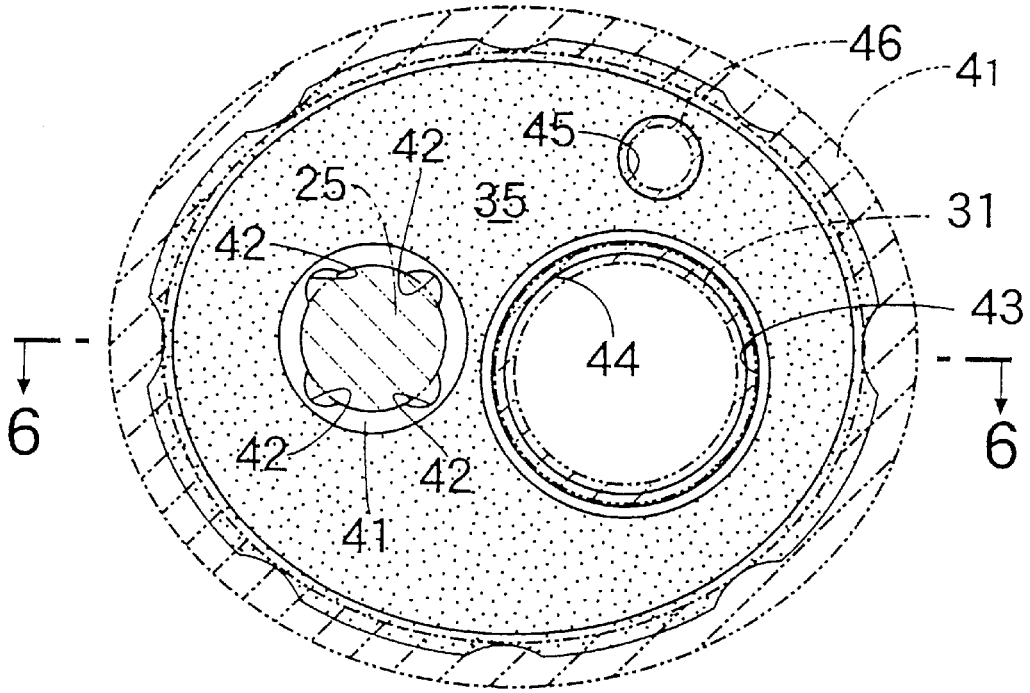
FIG. 5 is a sectional view taken along a line 5—5 in FIG. 3.
Figure 6:
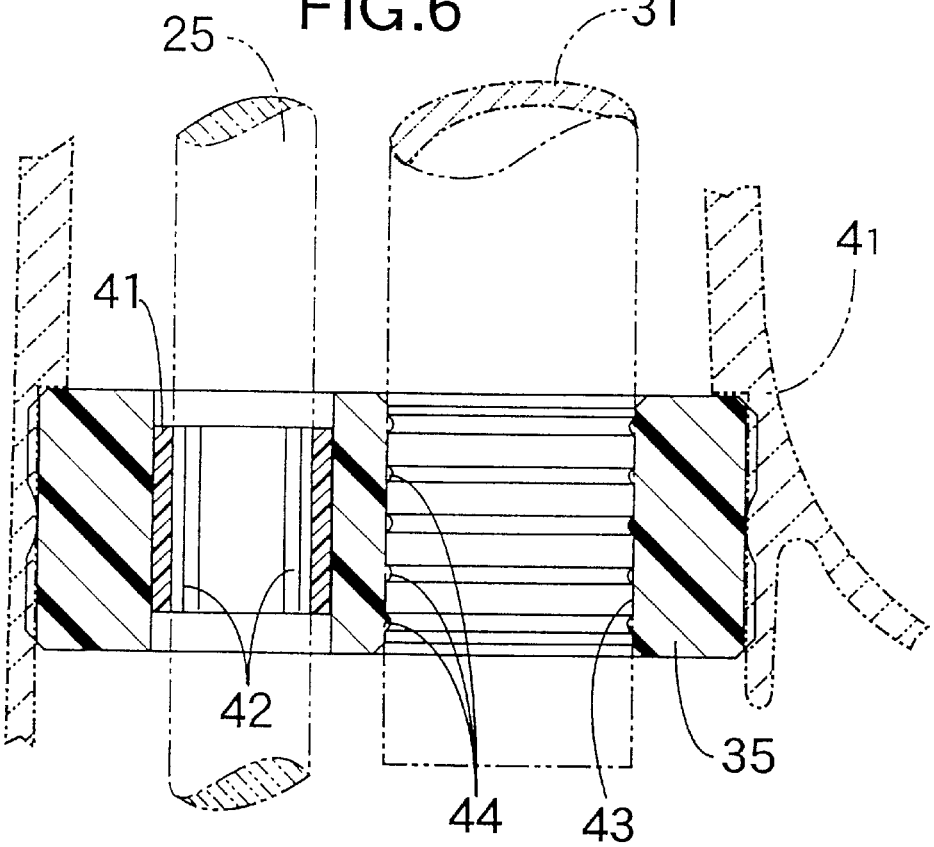
FIG. 6 is a sectional view taken along a line 6—6 in FIG. 5.

Referring first to FIGS. 1 to 3, a propelling unit 2 of an outboard engine system 1 includes a vertical air-cooled engine 3 having a crankshaft 23 directed vertically, an extension case 4 extending downwards and having at its upper end an engine support portion 5 for supporting the engine 3. A gear case 6 is coupled to a lower end of the extension case 4.

The extension case 4 is comprised of an extension case body $\mathbf{4}_1$ connected to the engine support portion 5, and an additional case $\mathbf{4}_2$ detachably interposed between the extension case body $\mathbf{4}_1$ and the gear case 6. Specifically, the extension case body $\mathbf{4}_1$ and the additional case $\mathbf{4}_2$ are separably coupled to each other by fastening bulged portions 4*a* and 4*b* formed at opposed ends to each other by bolts 20. The additional case $\mathbf{4}_2$ and the gear case 6 are also separably coupled to each other by fastening bulged portions 4*c* and 6*a* formed at opposed ends to each other by bolts 21.

An undercase 7 for accommodating a lower portion of the engine 3 is secured to an upper portion of the extension case 4, and an engine hood 8 is detachably mounted to the undercase 7 to cover an upper portion of the engine 3.

Further, formed around an outer periphery of the extension case 4 are an upper journal 9*a* located immediately below the undercase 7, and a lower journal 9*b* located below the upper journal 9*a*. A swivel case 11, which supports the upper journal 9*a* for rotation with a bearing bush 10 interposed therebetween, is connected to a pair of left and right stern brackets 13, 13 by a horizontal pivot 12. Each of the stern brackets 13 includes at its upper portion a clamp 14 for fastening the stern bracket 13 to a transom Bt of a boat B. A thrust receiver 15 for separably supporting the front surface of the lower journal 9*b* is connected to a lower portion of the bracket 13 through a pin-regulated trimming device 16.

A steering bar handle 17 is mounted to one side of the engine 3 or the extension case 7 through a horizontal pivot 18. The bar handle 17 can be turned to a forward moving position in which it has been turned to a side opposite to a propeller 22 which will be described hereinafter, and a backward moving position in which it has been turned to the same side as the propeller 22.

A drive shaft 25 is connected to the crankshaft 23 of the engine 3 through a centrifugal clutch 24 and is disposed vertically within the extension case 4 and the gear case 6. A propeller shaft 34 having the propeller 22 mounted at its rear end is supported horizontally in the gear case 6, and a bevel gear device 26 is accommodated in the gear case 6 and connects the drive shaft 25 to the propeller shaft 34.

The drive shaft 25 is supported at its upper end, through a bearing 29, in a clutch case 28 which is secured to a crankcase 27 of the engine 3 and in which the centrifugal clutch 22 is accommodated.

An exhaust pipe 31 connected to an exhaust port in the engine 3, is disposed within the extension case 4, and opens at its outlet into the extension case 4. An idle relief port 32 is provided in an upper portion of the exhaust pipe 31 for preventing an increase in back pressure during idling of the engine 3, so that the exhaust gas exiting the idle relief port 32 is discharged to the outside through ventilating bores 33 provided in a rear portion of the undercase 7.

As shown in FIGS. 3 to 6, a supporting member 35 made of an elastic material such as a rubber is mounted by press-fitting, to a lower portion of the extension case body $\mathbf{4}_1$ for suppressing the deflection of the driving shaft 25 and the exhaust pipe 31. The inside of the extension case 4 is partitioned by the supporting member 35 into an upper chamber $\mathbf{36}_1$ adjacent the engine 3, and a lower chamber $\mathbf{36}_2$ adjacent the gear case 6.

The upper chamber $\mathbf{36}_1$ opens into the open air through an air vent bore 37 provided in an upper wall of the extension case body $\mathbf{4}_1$. The lower chamber $\mathbf{36}_2$ is designed to communicate with the exterior, below the surface of outside water W around the extension case 4 through an exhaust outlet 38 defined rearwards between the bulged portions 4*c* and 6*a* of the additional case $\mathbf{4}_2$ and the gear case 6 and through a plurality of vertically-arranged water intake bores 39 made in laterally one side wall of a lower portion of the additional case $\mathbf{4}_2$. U-shaped guiding projection walls 50 having opposite ends directed forwards are formed on the outer surface of the additional case $\mathbf{4}_2$ with each water intake bore 39 interposed between the adjacent projection walls.

The additional case $\mathbf{4}_2$ is isolated from the inside of the gear case 6 by a seal member 40 mounted to the gear case 6.

A bearing bush 41 made of a synthetic resin is embedded in the support member 35 for supporting an intermediate portion of the driving shaft 25 for rotation, and a plurality of cooling grooves 42 are defined in an inner peripheral surface of the bearing bush 41, and extend axially to permit communication between the upper and lower chambers $\mathbf{36}_1$ and $\mathbf{36}_2$.

A plurality of annular beads 44 are formed in a through-bore 43 provided in the support member 35 through which the exhaust pipe 31 passes, so that the beads 44 are resiliently brought into contact with an outer peripheral surface of a lower end portion of the exhaust pipe 31. Thus, the exhaust pipe 31 supported in the support member 35, opens at its outlet end into the lower chamber $\mathbf{36}_2$.

Further, a through-bore 45 having a diameter smaller than that of the through-bore 43 is provided in the support member 35, and a communication pipe 46 is tightly fitted into the through bore 45 and connects the upper and lower chambers $\mathbf{36}_1$ and $\mathbf{36}_2$ to each other. In this case, the lower end 46*b* of the communication pipe 46 which has an oblique cut, is disposed so that it opens at substantially the same level as the water intake bore 39, and an upper end 46*a* of the communication pipe 46 is disposed, so that it opens into the substantially lowermost portion of the upper chamber $\mathbf{36}_1$.

Figure 7:
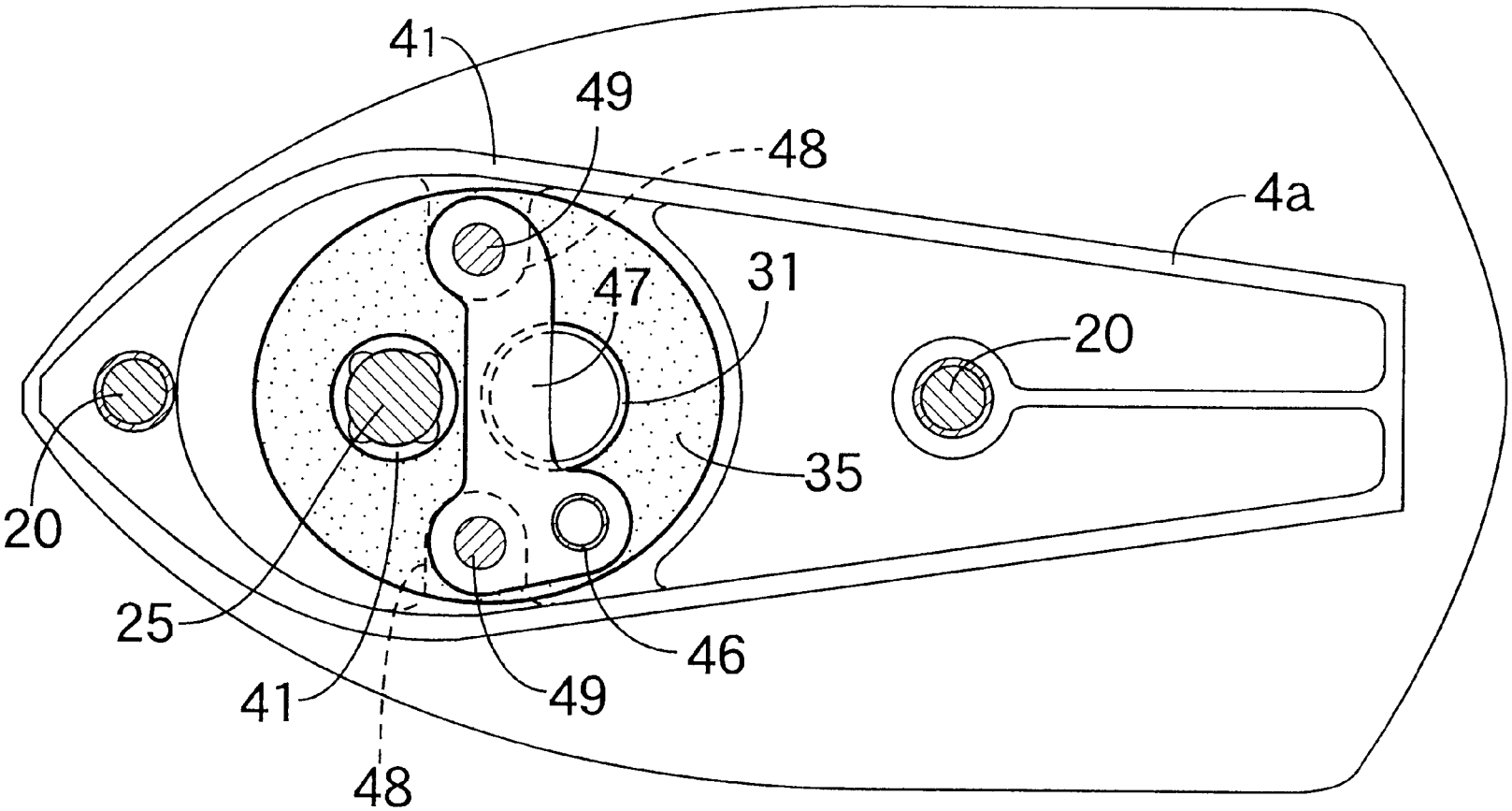
FIG. 7 is a sectional view taken along a line 7—7 in FIG. 3.
Figure 8:
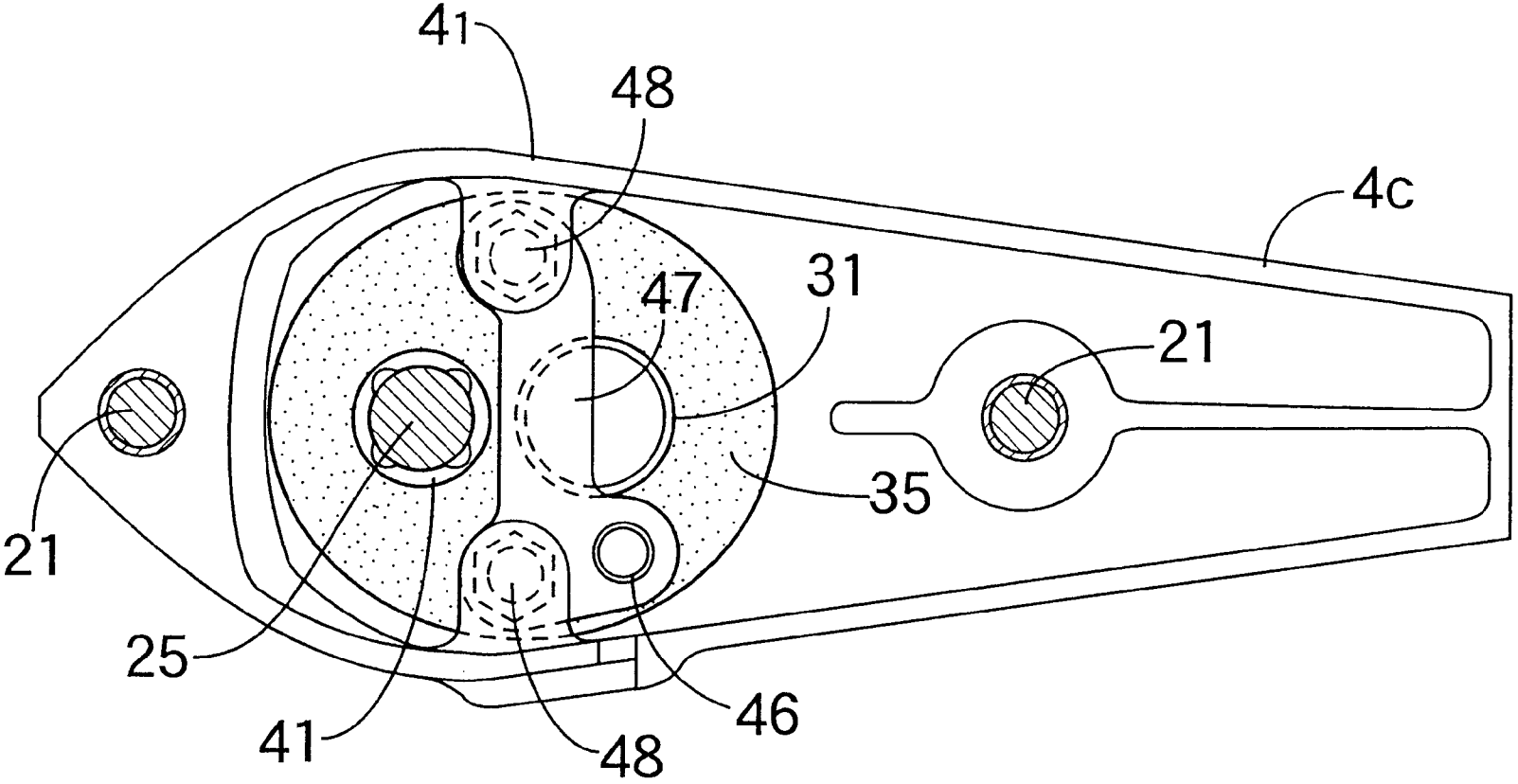
FIG. 8 is a sectional view taken along a line 8—8 in FIG. 3.

As shown in FIGS. 3, 7 and 8, a bracket plate 47 is welded to an intermediate portion of the communication pipe 46 and secured to a boss 48 mounted on an inner wall of the additional case $\mathbf{4}_2$ by bolts 49. In this manner, the communication pipe 46 is mounted to the additional case $\mathbf{4}_2$.

The operation of the embodiment will be described below.

In a stopped state of the engine, the outside water around the extension case 4 is permitted to enter the inside of the extension case 4 through the exhaust outlet 38 and the water intake bores 39, so that the level thereof is the same as that of the outside water outside the extension case 4.

When the engine 3 is started, whereby the rotational speed of the crankshaft 23 is increased to become equal to or higher than a predetermined value slightly higher than the idle rotational speed, the centrifugal clutch 24 is automatically brought into an engaged state, thereby causing the rotational torque of the crankshaft 23 to be transmitted to the drive shaft 25 and further transmitted through the bevel gear device 26 to the propeller shaft 34 to rotate the propeller 22. Thus, the boat B can cruise. In this case, the generation of the vibrations of the drive shaft 25 and the exhaust pipe 31 and the generation of a noise can be prevented, because the intermediate portion of the long drive shaft 25 and the lower end of the exhaust pipe 31 are supported on the support member 35 mounted to the extension case 4, and the deflection of the drive shaft 25 and the exhaust pipe 31 is suppressed.

The exhaust gas from the engine 3 is discharged through the exhaust pipe 31 above the surface of the water in the lower chamber $\mathbf{36}_2$ in the extension case 4. Therefore, the exhaust gas is discharged along with the water into the outside water, while urging the water surface down into the lower chamber $\mathbf{36}_2$. On the other hand, with cruising movement of the boat B, a portion of the water flow produced on the outer surface of the extension case 4 is guided to the U-shaped guiding projection walls 50 on the outer surface and introduced through the water intake bores 39 into the lower chamber $\mathbf{36}_2$ by dynamic pressure. Therefore, the surface of the water in the lower chamber $\mathbf{36}_2$ is substantially stabilized at an intermediate level between the water intake bores and the exhaust outlet 38. The lower end of the communication pipe 46 which has the oblique cut is disposed in the vicinity of or below the surface of the water in the extension case 4 and hence, the water in the lower chamber $\mathbf{36}_2$ or a mixture of the water and the exhaust gas is forced up into the upper chamber $\mathbf{36}_1$ through the communication pipe 46 by the difference in pressure between the upper chamber $\mathbf{36}_1$ having the atmospheric pressure and the lower chamber $\mathbf{36}_2$ having pressure raised by the exhaust pressure. The water is accumulated on the support member 35 to cool the support member 35 as well as the drive shaft 25 and the exhaust pipe 31 supported on the support member 35.

The water passes through the cooling grooves 42 in the inner peripheral surface of the bearing bush 41 embedded in the support member 35 and drops into the lower chamber $\mathbf{36}_2$. Therefore, it is possible to effectively cool the bearing bush 41 and the drive shaft 25 supported thereon and rotated, and at the same time, it is possible to suitably suppress the increase in amount of water accumulated on the support member 35.

However, if the water is accumulated on the support member 35 to such an extent that the upper end 46*a* of the communication pipe 46 is submerged in the water, then the movement of the water from the lower chamber $\mathbf{36}_2$ into the upper chamber $\mathbf{36}_1$ is stopped at the time when the pressures in the upper and lower ends of the communication pipe 36 are balanced with each other. Therefore, the amount of water accumulated in the support member 35 cannot be increased without limitation.

The exhaust gas moved into the upper chamber $\mathbf{36}_1$ is discharged through the air vent bore 37 provided in the upper portion thereof into the open air and hence, the upper chamber $\mathbf{36}_1$ is still maintained at the atmospheric pressure.

Figure 9:
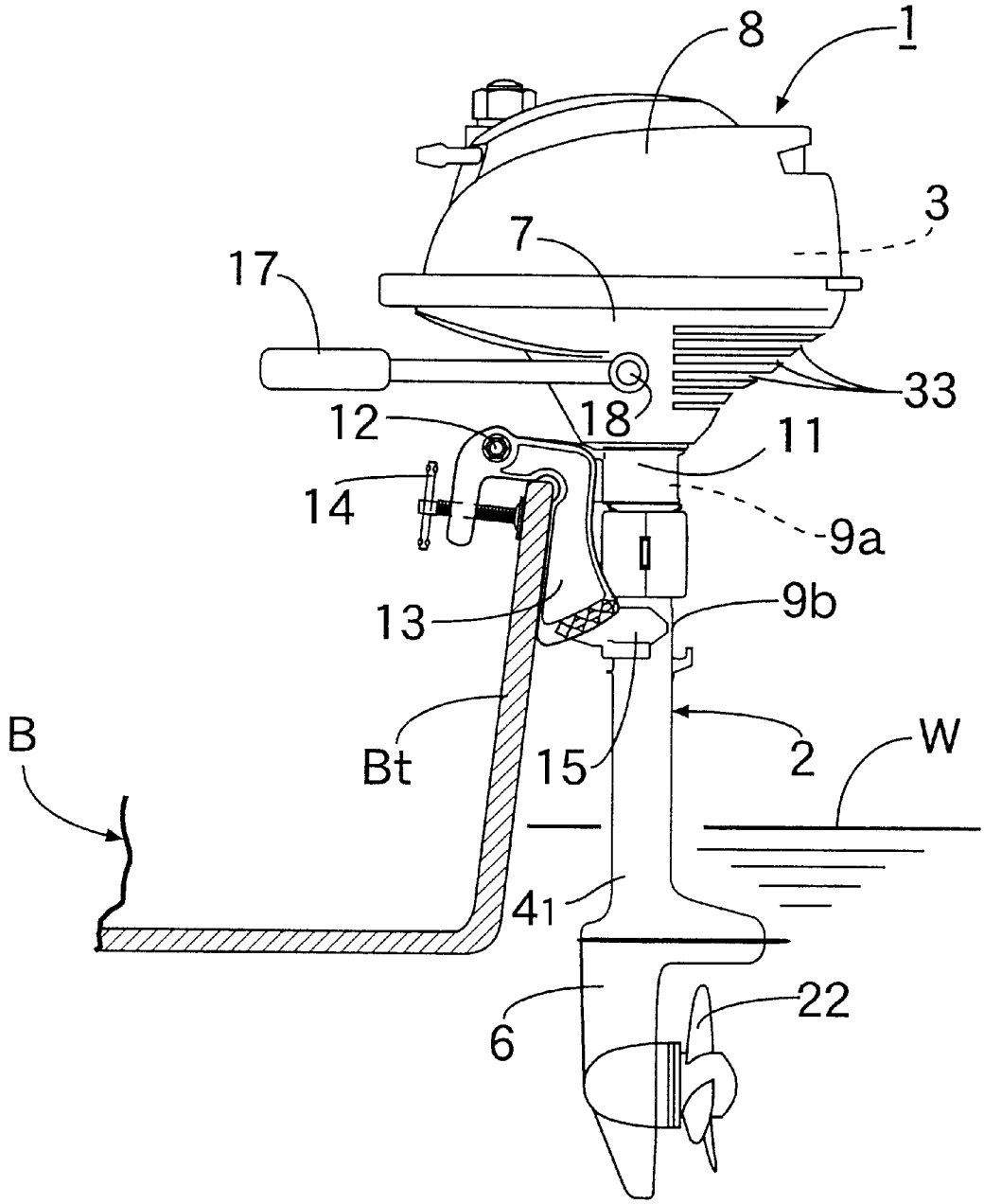
FIG. 9 is a side view of an outboard engine system in which a portion of the above-described outboard engine system is modified, so that the system can be mounted to a standard-height transom of a boat.
Figure 10:
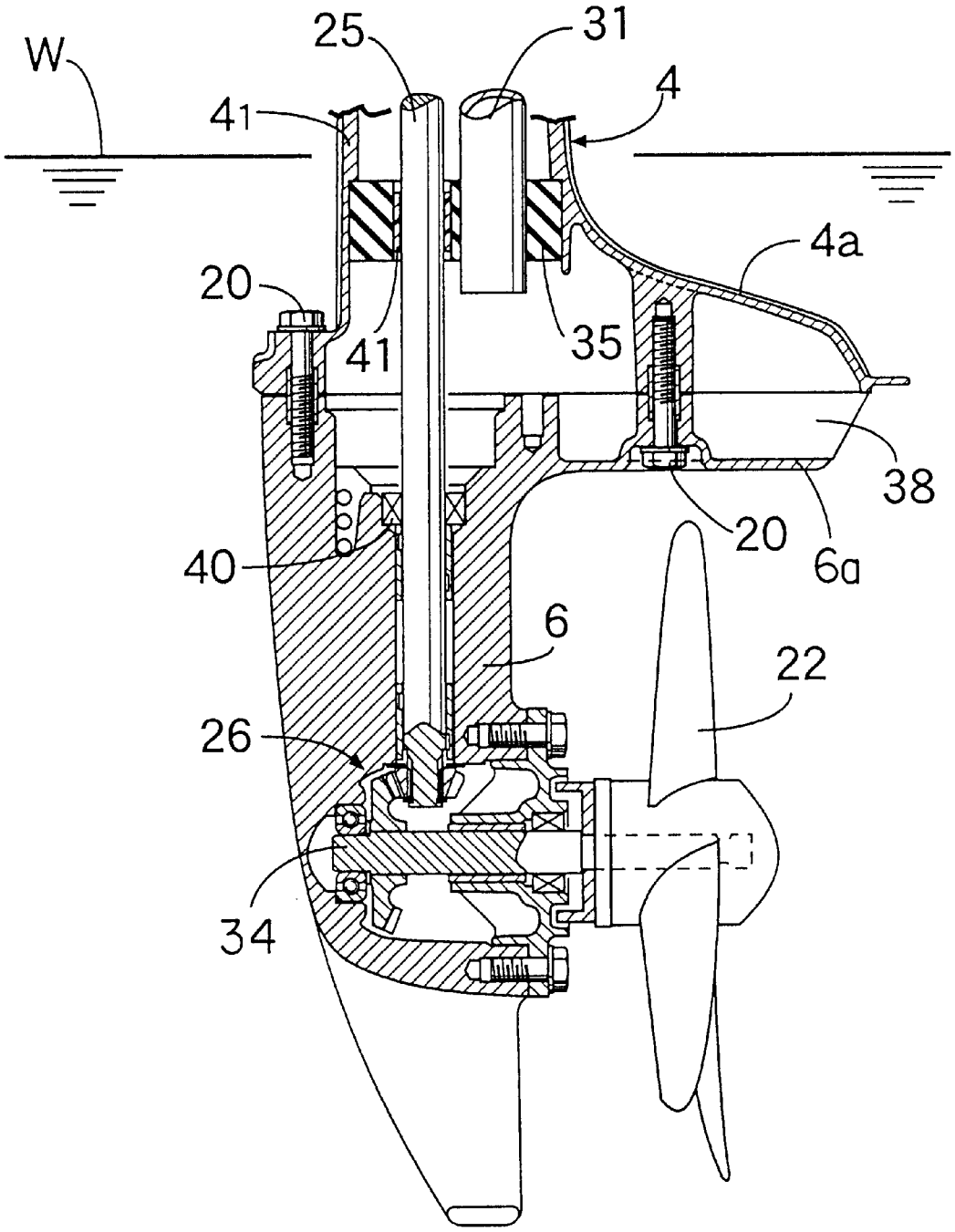
FIG. 10 is an enlarged sectional view of a lower portion of the outboard engine system.

FIGS. 9 and 10 are a side view of an outboard engine system in which a portion of the above-described outboard engine system 1 is modified, so that the system can be mounted to a standard-height transom Bt of a boat B, and an enlarged sectional view of a lower portion of the outboard engine system, respectively.

As can be seen from FIGS. 9 and 10, when the outboard engine system 1 is to be mounted to the standard-height transom Bt of the boat B, the additional case $\mathbf{4}_2$ and the communication pipe 46 are removed, and the drive shaft 25 is replaced by a shorter one. Then, the bulged portion 6*a* of the gear case 6 is coupled directly to the bulged portion 4*a* of the extension case body $\mathbf{4}_1$, and an exhaust outlet 38 is defined between the bulged portions 4*a* and 6*a*.

Even in this case, the support member 35 is left in the extension case body $\mathbf{4}_1$ to support the drive shaft 25 and the exhaust pipe 31 and hence, the deflection of the drive shaft 25 and the exhaust pipe 31 can be suppressed. In addition, the support member 35 is disposed in proximity to the exhaust outlet 38 and hence, the lower surface of the support member 35 is brought into direct contact with the outside water, permitted to enter the lower chamber $\mathbf{36}_2$ through the exhaust outlet 38. Thus, even if the communication pipe 46 is not mounted, the support member 35 can be reliably cooled.

As discussed above, the inside of the extension case is divided by the support member into the upper chamber communicating with the open air, and the lower chamber defined so that the outside water existing around the extension case is introduced into the lower chamber. The communication pipe is mounted between the upper and lower chambers, and opens at its lower end into the lower chamber in the vicinity of or below the surface of the outside water introduced into the lower chamber, and at the other end into the upper chamber. The exhaust gas pressure introducing means is connected to the lower chamber for introducing the exhaust gas pressure from the engine into the lower chamber. The support member and the depending member are cooled by the outside water forced up from the lower chamber through the communication pipe into the upper chamber by the difference in pressure between the upper and lower chambers during operation of the engine. Therefore, during operation of the engine, the outside water can be forced up from the lower chamber into the upper chamber by utilizing the exhaust pressure without recourse to a special water pump, thereby cooling the support member and the depending members. The increase in cost due to the cooling device is thus very small.

The depending member is the drive shaft for transmitting the power of the engine to the gear device, and the cooling grooves are defined in the inner peripheral surface of the bearing bush mounted on the support member to support the intermediate portion of the drive shaft for rotation, so that the upper and lower chambers are permitted to communicate with each other through the cooling grooves. Therefore, the water forced up from the lower chamber into the upper chamber passes through the cooling grooves in the inner peripheral surface of the bearing bush and drops into the lower chamber, whereby the bearing bush and the drive shaft can be effectively cooled, and the increase in amount of water accumulated on the support member can be suitably suppressed.

The depending member is the exhaust pipe of the engine which opens at its outlet into the lower chamber. Therefore, it is possible to easily perform the introduction of the exhaust pressure into the lower chamber by the exhaust pipe, and to inhibit the deflection of the exhaust pipe and to cool the exhaust pipe.

The extension case is provided with the exhaust outlet which permits the lower chamber to open below the surface of the outside water around the extension case, and the water intake bores for introducing the outside water into the lower chamber. Therefore, the surface of the water within the lower chamber can be stabilized to stabilize the forcing-up of the water through the communication pipe into the upper chamber, by balancing the discharge of the water from the lower chamber into the exhaust outlet by the exhaust pressure with the introduction of the outside water through the water intake bores into the lower chamber.

The water intake bores are formed in the lateral sidewall of the extension case, and the guiding projection walls are formed in the sidewall of the extension case for guiding the outside water into the water intake bores during cruising of the boat. Therefore, it is possible to reliably perform the introduction of the outside water into the lower chamber by utilizing an outside water flow during cruising of the boat.

The extension case is comprised of the extension case body connected to the engine support portion, and the additional case is detachably interposed between the extension case body and the gear case. The support member is mounted in the lower portion of the extension case body. Therefore, even when the additional case is removed and the gear case is coupled directly to the extension case body, the deflection of the depending members, i.e., the drive shaft and the exhaust pipe can be still suppressed by the support member left in the extension case.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A cooling device in an outboard engine system comprising an engine, a propeller shaft, a gear device for driving the propeller shaft, an engine support portion for supporting the engine, a gear case for supporting the propeller shaft and for housing the gear device, an extension case for connecting the engine support portion and the gear case, and a support member mounted in the extension case for suppressing the deflection of a depending member depending from the engine into the extension case, wherein the inside of the extension case is divided by the support member into an upper chamber communicating with the open air, and a lower chamber defined so that the outside water existing around the extension case is introduced into the lower chamber, a communication pipe mounted between the upper and lower chambers, the communication pipe opening at the lower end thereof into the lower chamber at or below the surface of the outside water introduced into the lower chamber, and opening at the other end thereof into the upper chamber, and an exhaust gas pressure introducing means connected to the lower chamber for introducing the exhaust gas pressure from the engine into the lower chamber, whereby the support member and the depending member are cooled by the outside water forced up from the lower chamber through the communication pipe into the upper chamber by the difference in pressure between the upper and lower chambers during operation of the engine.

2. A cooling device in an outboard engine system according to claim 1, wherein the depending member is a drive shaft for transmitting power from the engine to the gear device, the engine system including a bearing bush mounted on the support member, wherein cooling grooves are defined in the inner peripheral surface of the bearing bush, the bearing bush supporting an intermediate portion of the drive shaft for rotation, such that the upper and lower chambers communicate with each other through the cooling grooves.

3. A cooling device in an outboard engine system according to claim 1, wherein the depending member is an exhaust pipe which opens at the outlet thereof into the lower chamber.

4. A cooling device in an outboard engine system according to any one of claims 1 to 3, wherein the extension case has an exhaust outlet for allowing the lower chamber to open below the surface of the outside water, and water intake bores for introducing the outside water into the lower chamber.

5. A cooling device in an outboard engine system according to claim 4, wherein the water intake bores are formed in a lateral sidewall of the extension case, and guiding projection walls are formed in the sidewall of the extension case for guiding outside water into the water intake bores.

6. A cooling device in an outboard engine system according to any one of claims 1 to 3, wherein the extension case comprises an extension case body connected to the engine support portion, and an additional case detachably positioned between the extension case body and the gear case, and wherein the support member is mounted in a lower portion of the extension case body.

* * * * *